US009388955B2

(12) United States Patent
Shin

(10) Patent No.: US 9,388,955 B2
(45) Date of Patent: Jul. 12, 2016

(54) LASER OPTICAL SYSTEM FOR HEAD LAMP

(71) Applicant: Hyundai Motor Company, Seoul (KR)

(72) Inventor: Jik Soo Shin, Incheon (KR)

(73) Assignee: Hyundai Motor Company, Seoul (KR)

( * ) Notice: Subject to any disclaimer, the term of this patent is extended or adjusted under 35 U.S.C. 154(b) by 41 days.

(21) Appl. No.: 14/559,341

(22) Filed: Dec. 3, 2014

(65) Prior Publication Data

US 2016/0091160 A1 Mar. 31, 2016

(51) Int. Cl.
*F21S 8/10* (2006.01)
*F21Y 101/02* (2006.01)

(52) U.S. Cl.
CPC ..... *F21S 48/1208* (2013.01); *F21S 48/115* (2013.01); *F21S 48/1225* (2013.01); *F21S 48/1317* (2013.01); *F21S 48/142* (2013.01); *F21S 48/1763* (2013.01); *F21Y 2101/025* (2013.01)

(58) Field of Classification Search
CPC . F21S 48/1208; F21S 48/115; F21S 48/1225; F21S 48/1317; F21S 48/142; F21S 48/1763; F21S 48/11; F21S 48/1127; F21S 48/1145; F21S 48/1154; F21S 48/1216; F21V 13/12; F21V 13/14; F21Y 2101/025
See application file for complete search history.

(56) References Cited

U.S. PATENT DOCUMENTS 9,080,732 B2 * 7/2015 Nozaki ..... F21S 48/115
2013/0258689 A1 * 10/2013 Takahira ..... F21S 48/17 362/465
2013/0343076 A1 12/2013 Nakada et al.

FOREIGN PATENT DOCUMENTS

JP 2009-224053 A 10/2009
KR 10-2011-0084785 A 7/2011
KR 10-2011-0097872 A 8/2011
KR 10-2012-0131534 A 12/2012
WO WO 2013/0494222 A1 6/2013

* cited by examiner

*Primary Examiner* — Bao Q Truong
(74) *Attorney, Agent, or Firm* — Morgan, Lewis & Bockius LLP

(57) ABSTRACT

A laser optical system for a head lamp may include a laser diode, a pattern film having a surface on which a micro pattern is formed to diffuse a laser beam emitted from the laser diode and to specify a width and a height of the beam in accordance with a desired form, a reflective film having a film hole formed thereon to pass the laser beam that is diffused through the pattern film, a phosphor film formed in a film shape to react on the laser beam that passes through the reflective film to output white light, and an aspheric lens configured to direct the white light that permeates the phosphor film to a front area. The laser diode and the aspheric lens, and/or other components in between, may be arranged in a line.

8 Claims, 4 Drawing Sheets

LASER OPTICAL SYSTEM FOR HEAD LAMP

CROSS-REFERENCE(S) TO RELATED APPLICATIONS

The present application claims priority of Korean Patent Application Number 10-2014-0129161 filed Sep. 26, 2014, the entire contents of which are incorporated herein for all purposes by this reference.

BACKGROUND OF THE INVENTION

1. Field of the Invention

The present invention relates to a laser optical system for a head lamp; and, particularly, to a laser optical system for a head lamp, which can increase optical efficiency through minimization of a light loss and can heighten design degree of freedom through reduction of a size of the optical system.

2. Description of Related Art

A head lamp (headlight) of a vehicle is a lamp that illuminates a front area to secure a driver's front visual field, and halogen, HID (High Intensity Discharge), or an LED diode has been generally used as a light source.

However, since the halogen, HID, or LED diode has high power consumption, the optical efficiency thereof is lowered. In particular, since the overall size of an optical system including a light source and a lens is large, the design degree of freedom becomes low and the weight of the optical system becomes heavy.

Recently, development of a head lamp that uses a laser diode, which is environment friendly and has long lifespan and high optical efficiency, as a light source is on an increasing trend.

As illustrated in FIG. 1, a laser optical system for a head lamp in the related art is configured to include a laser diode 1 generating a laser beam of a blue wavelength band, a yellow phosphor 2 reacting on light emitted from the laser diode 1 to output white light, a reflective body 3 reflecting the white light output from the phosphor 2 to a front area, an aspheric lens 4 positioned in front of the reflective body 3 to condense, diffuse, and apply the white light that is reflected through the reflective body 3 to the front area, and a shield 5 positioned between the reflective body 3 and the aspheric lens 4 to implement a low beam.

However, according to the configuration of the laser optical system in the related art as described above, the light emitted from the laser diode 1 is incident to the phosphor 2 to be excited, and then is output to the front area where the aspheric lens 4 is present by reflection through the reflective body 3. Accordingly, since the front area of the reflective body 3 is opened to output the white light, a light loss section A1, in which the light emitted from the laser diode 1 is excited by the phosphor 2 and then is emitted out of the reflective body 3, occurs, and thus the light loss of the optical system is generally increased to cause the optical efficiency to be decreased.

That is, the structure in the related art is configured to use the reflective body 3 for forward emission of the white light, and if the reflective body 3 is used, the light loss section A1, in which the white light is emitted out of the reflective body 3, occurs, and thus the light loss of the optical system is generally increased to cause the optical efficiency to be decreased.

Further, since the reflective body 3 having a large volume is used, the weight of the optical system becomes heavy, and the size of the optical system is increased. Accordingly, the design degree of freedom becomes disadvantageous, and further the manufacturing cost is increased.

The information disclosed in this Background section is only for enhancement of understanding of the general background of the invention and should not be taken as an acknowledgement or any form of suggestion that this information forms the prior art already known to a person skilled in the art.

SUMMARY OF THE INVENTION

In order to solve the above-described drawbacks and/or other problems, the present invention provides a laser optical system for a head lamp, which is configured so that a laser beam that is emitted from a laser diode is excited or absorbed by a phosphor and then is directly output to an aspheric lens, and thus can eliminate a light loss section that is caused by the use of the reflective body in the related art through non-use of the reflective body to achieve minimization of the light loss and improvement of optical efficiency. In particular, the present invention provides a laser optical system for a head lamp, which can reduce the size of the optical system, and thus can achieve weight reduction, saving of the manufacturing cost, and heightening of the design degree of freedom.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with various aspects of the present invention, a laser optical system for a head lamp includes a laser diode; a pattern film having a surface on which a micro pattern is formed to diffuse a laser beam emitted from the laser diode and to specify a width and a height of the beam in accordance with a desired form; a reflective film having a film hole formed thereon to pass the laser beam that is diffused through the pattern film; a phosphor film formed in a film shape to react on the laser beam that passes through the reflective film to output white light; and an aspheric lens configured to direct the white light that permeates the phosphor film to a front area, wherein the laser diode and the aspheric lens are arranged in a line.

The laser optical system may further include a rear holder in which the pattern film and the reflective film are coupled to each other and face each other; a front holder in which the phosphor film is combined so that the phosphor film is positioned in front of the reflective film; and a plurality of holder brackets configured to connect the rear holder and the front holder with each other.

The laser optical system may further include a reflection coating combined with a front surface of the reflective film that faces the phosphor film to reflect a portion of the laser beam, which is unable to be excited or absorbed by the phosphor film but is scattered to a rear area, to the front area, thereby improving an optical efficiency.

The micro pattern may be formed as an elliptical projection to implement a low beam. The micro pattern may be formed as a circular projection to implement a high beam. The film hole may be formed in a shape substantially the same as a shape of the micro pattern.

The laser optical system may further include a shield coupled with the front holder to face the phosphor film when a low beam is implemented and having a cutoff line formed thereon.

The reflection coating may be silver-colored reflection silver coating to implement a hidden effect through deposition when the laser diode is turned off According to the present invention, the laser optical system is configured so that the laser beam that is emitted from the laser diode is excited or absorbed by the phosphor film, and then the white light is directly output to the front area through the aspheric lens. Accordingly, the light loss of the optical system can be minimized, and thus the optical efficiency can be increased. Further, through the size reduction of the optical system, the weight reduction and saving of the manufacturing cost can be sought, and the design degree of freedom can be heightened.

The methods and apparatuses of the present invention have other features and advantages which will be apparent from or are set forth in more detail in the accompanying drawings, which are incorporated herein, and the following Detailed Description, which together serve to explain certain principles of the present invention.

DESCRIPTION OF SPECIFIC EMBODIMENTS

Figure 1:
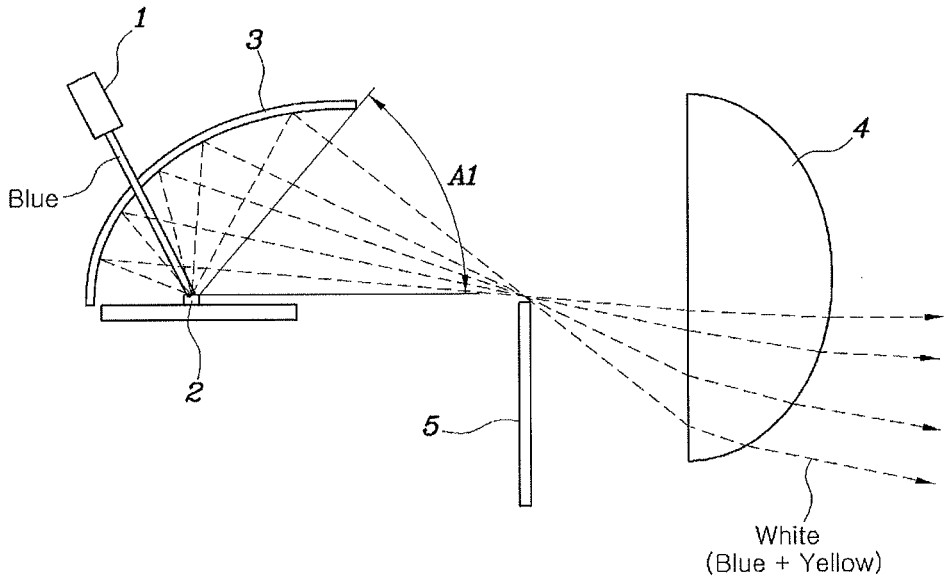
FIG. 1 (Related Art)
FIG. 1 is a view explaining a laser optical system for a head lamp in the related art.
Figure 2:
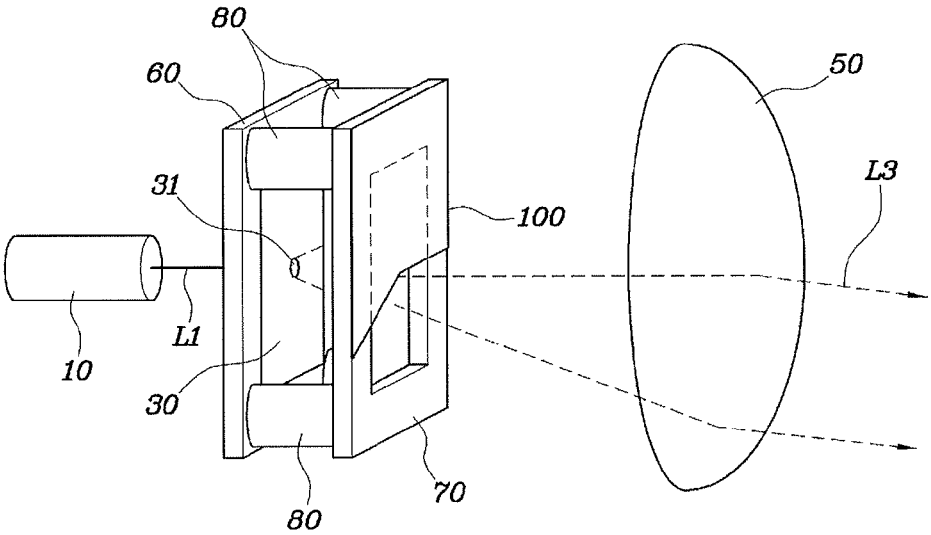
FIG. 2 and FIG. 3 are perspective views illustrating a combined state and an exploded state of an exemplary laser optical system for a head lamp according to the present invention.
Figure 3:
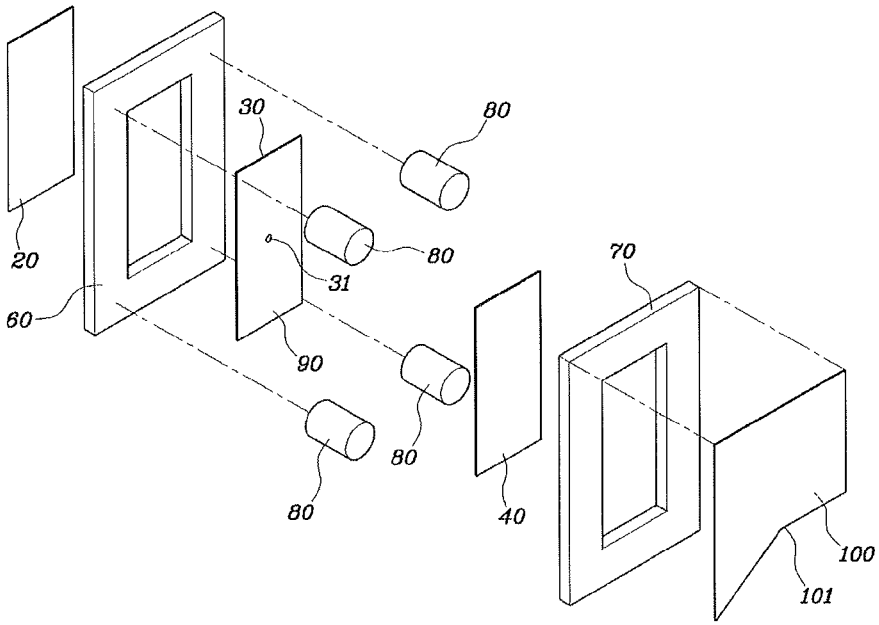
Figure 4:
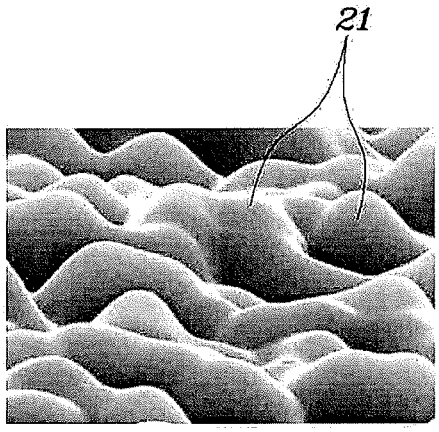
FIG. 4, FIG. 5 and FIG. 6 are views explaining a micro pattern according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Hereinafter, a laser optical system for a head lamp according to various embodiments of the present invention will be described with reference to the accompanying drawings.

As illustrated in FIGS. 2 to 7, a laser optical system for a head lamp according to the present invention includes a laser diode 10 generating a laser beam L1 of a blue wavelength band (e.g., normally short wavelength band of about 450 nm); a pattern film 20 having a surface on which a micro pattern 21 is formed to diffuse the laser beam L1 emitted from the laser diode 10 and to specify or define the width and the height of the beam to a desired form; a reflective film 30 having a film hole 31 formed thereon to pass the laser beam L2 that is diffused through the pattern film 20; a phosphor film 40 formed in a film shape to react on the laser beam that passes through the reflective film 30 to output white light L3; and an aspheric lens 50 directing, condensing and/or applying the white light that permeates the phosphor film 40 to a front area, wherein the laser diode 10 and the aspheric lens 50, and/or other components in between, are arranged in a line.

Here, the pattern film 20, the reflective film 30, and the phosphor film 40 are fixedly installed through a holder, and the holder is fixedly installed in a housing constituting the optical system. The holder includes a rear holder 60 in which the pattern film 20 and the reflective film 30 are combined with or couple to each other to face each other; a front holder 70 in which the phosphor film 40 is combined so that the phosphor film is positioned in front of the reflective film 30; and a plurality of holder brackets 80 connecting the rear holder 60 and the front holder 70 with each other.

Figure 7:
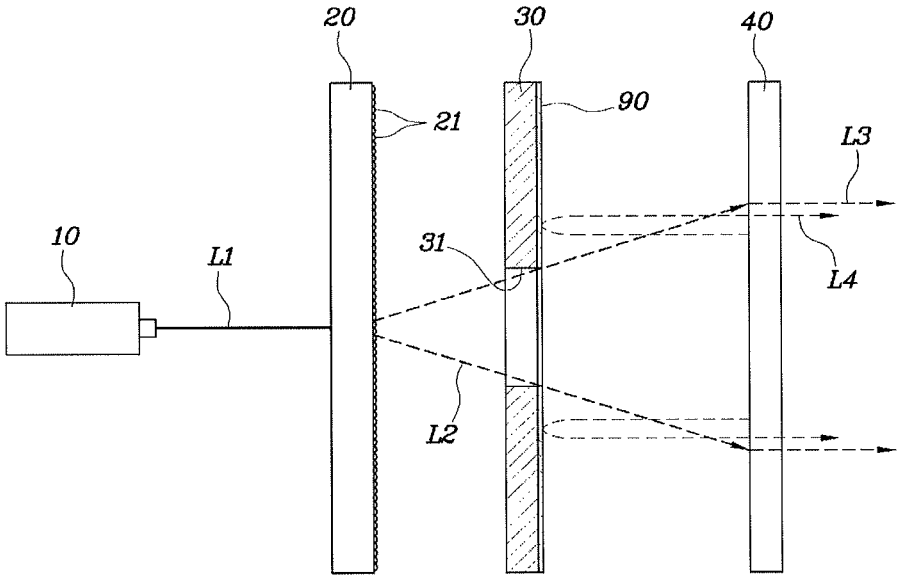
FIG. 7 is a view explaining a reflective film and reflection coating according to the present invention.

Further, the laser optical system further includes a reflection coating 90 combined with a front surface of the reflective film 30 that faces the phosphor film 40 to reflect the laser beam that is unable to be excited or absorbed by the phosphor film 40 when the laser diode 10 is turn on but is scattered to a rear area to the front area again to improve an optical efficiency (L4 in FIG. 7).

That is, the beam L1 emitted from the laser diode 10 becomes a beam L2 that is diffused to a specific shape as passing through the pattern film 20, and the diffused beam L2 is mostly excited or absorbed by the phosphor film 40 after passing through a film hole 31 of the reflective film 30 to output white light L3.

However, a part of the diffused beam L2 is unable to be excited or absorbed by the phosphor film 40, but is scattered to the rear area where the reflective film 30 is present. The reflection coating 90 according to the present invention serves to reflect the laser beam that is scattered to the rear area again to the phosphor film 40, and through this, the light loss due to the beam scattered to the rear area can be greatly reduced. In addition, since the quantity of light can be secured, the overall optical efficiency of the head lamp can be greatly improved.

On the other hand, in some embodiments, it is preferable that the reflection coating 90 according to the present invention is of great help in implementing high quality of the lamp through implementation of a hidden effect through deposition when the laser diode 10 is turned off. For this, it is preferable that the reflection coating 90 is silver-colored reflection silver coating.

Figure 5:
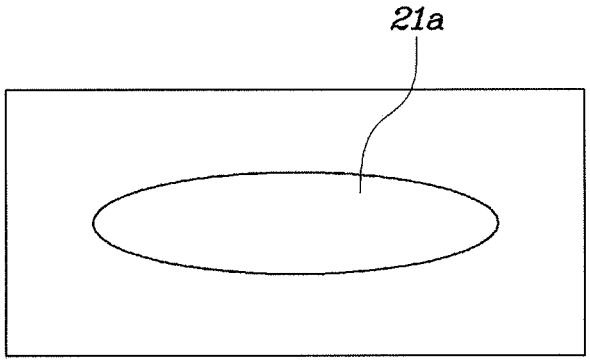
Figure 6:
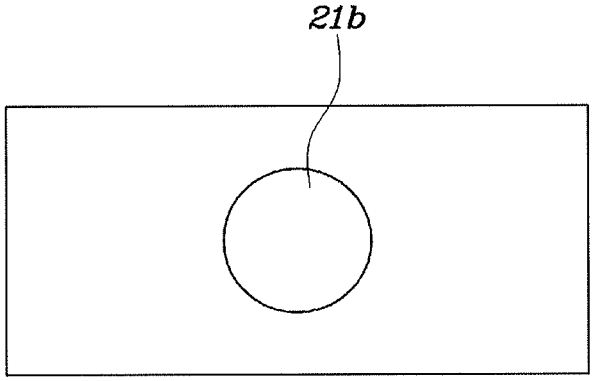

The micro pattern 21 according to the present invention may be formed as an elliptical projection 21*a* that is long in left and right directions as shown in FIG. 5 when a low beam is implemented, or may be formed as a circular projection 21*b* as shown in FIG. 6 when a high beam is implemented.

Further, it is preferable that the film hole 31 formed on the reflective film 30 is formed in the same shape as the pattern shape of the micro pattern 21, and through this, the beam pattern of a specific shape can be formed.

On the other hand, if it is intended to implement a low beam using the optical system according to the present invention, the optical system further includes a shield 100 on which a cutoff line 101 is formed. The shield 100 is integrally combined with a front surface portion of the front holder 70 to face the phosphor film 40.

However, in the case of implementing the high beam using the optical system according to the present invention, the shield 100 is not applied in principle.

Further, in some embodiments, the laser optical system for a head lamp according to the present invention further includes a PCB (printed circuit board) that controls current supply to the laser diode 10, and a heat sink that transfers heat generated from the laser diode 10 and the phosphor film 40 to an outside to dissipate the heat.

As described above, according to the laser optical system for a head lamp according to the present invention, the laser beam that is emitted from the laser diode 10 is excited or absorbed by the phosphor film 40, and then the white light is directly output to the front area through the aspheric lens 50. Accordingly, the light loss section that is caused by the use of the reflective body in the related art can be eliminated through the non-use of the reflective body, and through this, it becomes possible to achieve minimization of the light loss and improvement of the optical efficiency.

Further, according to the present invention, all constituent elements are arranged in a line without using the reflective body as in the related art. Accordingly, it becomes possible to reduce the size of the optical system, and thus weight reduction, saving of the manufacturing cost, and heightening of the design degree of freedom can be achieved.

Further, according to the present invention, the reflection coating 90 reflects a part of the laser beam, which is unable to be excited or absorbed by the phosphor film 40, but is scattered to the rear area, again to the phosphor film 40, and thus the reflected laser beam is excited or absorbed by the phosphor film 40 to cause the white light to be output. Through this, the light loss due to the beam scattered to the rear area can be greatly reduced. In addition, since the quantity of light can be secured, the overall optical efficiency of the head lamp can be greatly improved.

Further, the reflection coating 90 according to the present invention is of great help in implementing the high quality of the head lamp through implementation of the hidden effect through deposition when the laser diode 10 is turned off For convenience in explanation and accurate definition in the appended claims, the terms "front" or "rear", "left" or "right", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A laser optical system for a head lamp comprising:

a laser diode;

a pattern film having a surface on which a micro pattern is formed to diffuse a laser beam emitted from the laser diode and to specify a width and a height of the beam in accordance with a desired form;

a reflective film having a film hole formed thereon to pass the laser beam that is diffused through the pattern film;

a phosphor film formed in a film shape to react on the laser beam that passes through the reflective film to output white light; and an aspheric lens configured to direct the white light that permeates the phosphor film to a front area, wherein the laser diode and the aspheric lens are arranged in a line.

2. The laser optical system of claim 1, further comprising:

a rear holder in which the pattern film and the reflective film are coupled to each other and face each other;

a front holder in which the phosphor film is combined so that the phosphor film is positioned in front of the reflective film; and a plurality of holder brackets configured to connect the rear holder and the front holder with each other.

3. The laser optical system of claim 1, further comprising:

a reflection coating combined with a front surface of the reflective film that faces the phosphor film to reflect a portion of the laser beam, which is unable to be excited or absorbed by the phosphor film but is scattered to a rear area, to the front area, thereby improving an optical efficiency.

4. The laser optical system of claim 1, wherein the micro pattern is formed as an elliptical projection to implement a low beam.

5. The laser optical system of claim 1, wherein the micro pattern is formed as a circular projection to implement a high beam.

6. The laser optical system of claim 1, wherein the film hole is formed in a shape substantially the same as a shape of the micro pattern.

7. The laser optical system of claim 2, further comprising:

a shield coupled with the front holder to face the phosphor film when a low beam is implemented and having a cutoff line formed thereon.

8. The laser optical system of claim 3, wherein the reflection coating is silver-colored reflection silver coating to implement a hidden effect through deposition when the laser diode is turned off.

* * * * *